US010906772B1

(12) United States Patent
Bielfelt et al.

(10) Patent No.: US 10,906,772 B1
(45) Date of Patent: Feb. 2, 2021

(54) AUTOMATIC WATERCRAFT COVER AND RECEIVING SYSTEM

(71) Applicant: Timpte Industries, Inc., Denver, CO (US)

(72) Inventors: Terry J. Bielfelt, Omaha, NE (US); Martin E. Ourada, Lincoln, NE (US); Andrew F. Nickel, Bennet, NE (US)

(73) Assignee: Timpte Industries, Inc., Denver, CO (US)

( * ) Notice: Subject to any disclaimer, the term of this patent is extended or adjusted under 35 U.S.C. 154(b) by 2 days.

(21) Appl. No.: 16/531,910

(22) Filed: Aug. 5, 2019

Related U.S. Application Data

(63) Continuation of application No. 15/684,460, filed on Aug. 23, 2017, now Pat. No. 10,370,217.

(51) Int. Cl.

| | |
|---|---|
| ***B65H 75/44*** | (2006.01) |
| ***B63B 17/02*** | (2006.01) |
| ***B63C 1/02*** | (2006.01) |
| ***E02B 3/20*** | (2006.01) |
| *B63B 35/34* | (2006.01) |

(52) U.S. Cl.
CPC ..... *B65H 75/4481* (2013.01); *B63B 17/02* (2013.01); *B63B 35/34* (2013.01); *B63C 1/02* (2013.01); *E02B 3/20* (2013.01)

(58) Field of Classification Search
CPC ..... B63C 1/00; B63C 1/02; B63C 3/00
See application file for complete search history.

(56) References Cited

U.S. PATENT DOCUMENTS

| | | | |
|---|---|---|---|
| 4,363,284 | A | 12/1982 | Monroe et al. |
| 5,769,105 | A | 6/1998 | Margol et al. |
| 6,209,477 | B1 | 4/2001 | Biedenweg |
| 6,688,252 | B1 | 2/2004 | Caravella |
| 7,194,976 | B1 | 3/2007 | Kramer |

(Continued)

FOREIGN PATENT DOCUMENTS

| | | | |
|---|---|---|---|
| CA | 2943421 | A1 | 11/2015 |
| EP | 3140185 | A2 | 3/2017 |

(Continued)

OTHER PUBLICATIONS

International Search Report and the Written Opinion for Application No. PCT/US2018/047519, dated Nov. 29, 2018.

*Primary Examiner* — Tara Mayo-Pinnock
(74) *Attorney, Agent, or Firm* — Mallory M. Henninger; Advent, LLP

(57) ABSTRACT

The cover delivery device (e.g., for use in selectably covering a watercraft) can include a first mobile support assembly, a second mobile support assembly, a drive shaft, and a cover carrier mechanism. The first mobile support assembly is mounted to and configured for movement along a first rail. The second mobile support assembly is mounted to and configured for movement along a second rail, which is generally parallel to the first rail. The drive shaft extends between and is rotatably mounted to the first mobile support assembly and the second mobile support assembly. The cover carrier mechanism extends between and is rotatably mounted to the first mobile support assembly and the second mobile support assembly. The cover carrier mechanism is configured for selectably deploying a cover carried thereby, with the cover carrier mechanism being configured to respectively roll and unroll the cover relative thereto.

20 Claims, 4 Drawing Sheets

(56) References Cited

U.S. PATENT DOCUMENTS

| | | | |
|---|---|---|---|
| 8,601,971 | B2 | 12/2013 | Kent |
| 9,216,798 | B2 | 12/2015 | Kent |
| 9,409,628 | B2 | 8/2016 | Kent |
| 9,527,552 | B2 | 12/2016 | Hey et al. |
| 2003/0217683 | A1 | 11/2003 | Heckman |
| 2012/0180714 | A1 | 7/2012 | Bir, Jr. |
| 2013/0206051 | A1 | 8/2013 | Kent |
| 2013/0266377 | A1 | 10/2013 | Hey et al. |

FOREIGN PATENT DOCUMENTS

| | | | |
|---|---|---|---|
| WO | 2013044162 | A1 | 3/2013 |
| WO | 2015172110 | A2 | 11/2015 |

AUTOMATIC WATERCRAFT COVER AND RECEIVING SYSTEM

CROSS-REFERENCE TO RELATED APPLICATIONS

The present application is a continuation under 35 U.S.C. § 120 of U.S. patent application Ser. No. 15/684,460, filed Aug. 23, 2017, and titled "AUTOMATIC WATERCRAFT COVER AND RECEIVING SYSTEM," which is incorporated herein by reference in its entirety.

BACKGROUND

Covers can be used to protect watercraft such as boats, jet skis, or other types of marine vessels. Such covers can help protect the watercraft from the elements (e.g., sun, rain, hail, etc.) and/or the surrounding environment (e.g., insects, birds, etc.). Some attempts to automate the covering procedure have been made.

DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawing. The drawing is not necessarily to scale. In general, operations of disclosed processes may be performed in an arbitrary order, unless otherwise provided in the claims.

DETAILED DESCRIPTION

Overview

Figure 1:
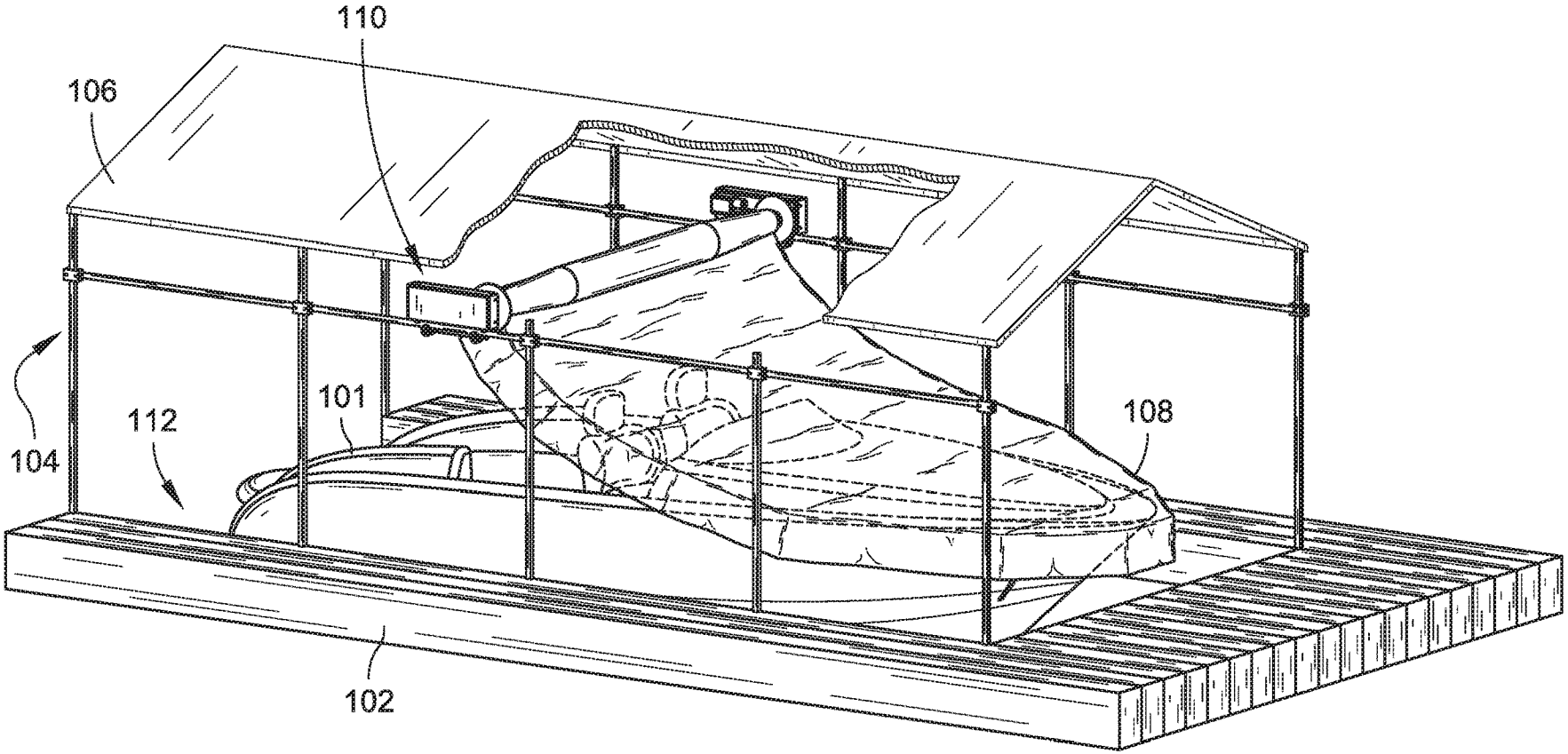
FIG. 1 is a front, side isometric view of an automatic cover delivery system in use with respect to a watercraft, with the cover partially deployed, in accordance with an example implementation of the present disclosure.

A cover delivery system (e.g., for use in selectably covering a watercraft), in accordance with an example embodiment of the present disclosure, generally includes a first rail, a second rail spaced apart from and extending generally parallel to the first rail, and a cover delivery device. The cover delivery system can include a first mobile support assembly, a second mobile support assembly, a shaft (e.g., a drive shaft), and a cover carrier mechanism. The first mobile support assembly is mounted to and configured for movement along the first rail. The second mobile support assembly is mounted to and configured for movement along the second rail. The drive shaft extends between and is rotatably mounted to the first mobile support assembly and the second mobile support assembly. The cover carrier mechanism extends between and is rotatably mounted to the first mobile support assembly and the second mobile support assembly. The cover carrier mechanism is configured for selectably deploying a cover carried thereby, with the cover carrier mechanism being configured to respectively roll and unroll the cover relative thereto.

In some implementations, a watercraft docking system includes, according to an example embodiment, generally includes a dock, a support structure, a first rail, a second rail, and a cover delivery device. The dock can be configured to be mounted over a body of water (e.g., permanent, floating, etc.) to facilitate ingress and/or egress relative to a watercraft. The dock can define a dock slip, with the dock slip being configured to receive a watercraft therein. The support structure is coupled to and/or carried by the dock. The support structure can be configured to extend to a height above a given watercraft received in the dock slip. The first rail and the second rail can be respectively carried by the support structure, with the second rail being spaced apart from and generally parallel to the first rail. The cover delivery device can generally include a first mobile support assembly, a second mobile support assembly, and a cover carrier mechanism. The first mobile support assembly can be mounted to and configured for movement along the first rail. The second mobile support assembly can be mounted to and configured for movement along the second rail. The cover carrier mechanism can extend between and be rotatably mounted to the first mobile support assembly and the second mobile support assembly. The cover carrier mechanism can be configured for selectably deploying a cover carried thereby relative to the watercraft. The cover carrier mechanism can be configured to respectively roll and unroll the cover relative thereto.

The cover delivery system and related cover can offer a number of advantages. The cover itself may be made of a material that is weather-resistant (e.g., water-resistant; sun and/or wind-blocking) and further may be capable of stretching to permit a tighter fit against a boat, watercraft, other vehicle, or, upon winding, the cover carrier mechanism. The cover carrier mechanism, used to directly carry and deliver the cover, can be diametrically wider in the middle thereof than on its ends, as the resulting profile helps to center the cover on the cover carrier mechanism. The cover can be provided with a series of attachment straps that allow the cover to remain attached to the cover carrier mechanism, even when the cover is completely unwound from the cover carrier mechanism. The cover carrier mechanism is coupled to and/or carried by a pair of mobile support assemblies, and at least one of those mobile support assemblies includes a slip clutch drive configured for rotatably driving the cover carrier mechanism. The slip clutch drive, by its design, offers the ability to limit the torque generated thereby (e.g., via slipping or spinning), thus allowing the cover to be wound or unwound (e.g., rolled/unrolled) at a substantially constant rate. The mobile support assemblies can be respectively movably mounted relative to a corresponding one of two parallel rails, and such mounting to the parallel rails facilitates an overall simple linear travel of the mobile support assemblies and the cover carrier mechanism. The rails retain the overall mechanism, less the cover itself, at a position above the watercraft at all points along the delivery cycle, affording an assured clearance of the watercraft. At least one of the mobile support assemblies includes a respective drive wheel configured to engage with a corresponding rail, and the given drive wheel may be made of a deformable material (e.g., rubber or another elastomer) to facilitate conformance with and suitable gripping of the corresponding rail.

The first mobile support assembly, the second mobile support assembly, the drive shaft, and the cover carrier mechanism can be respectively configured to move with respect to one another so as to control a delivery of the cover relative to an expanse of a watercraft. That is, the speed at which the first mobile support assembly and the second mobile support assemblies can be driven (e.g., by the drive shaft) along their respective rails is set to match the cover delivery (e.g., out feed or retrieval) relative to the expanse of the watercraft. In some embodiments, the rail speed and the wind/unwind speed can be chosen such that the cover is placed under tension (e.g., stretched across a watercraft for a tight fit thereon; wound tight on the cover carrier mechanism for efficient winding) in one or both directions of travel relative to the rails.

Example Implementations

Figure 2:
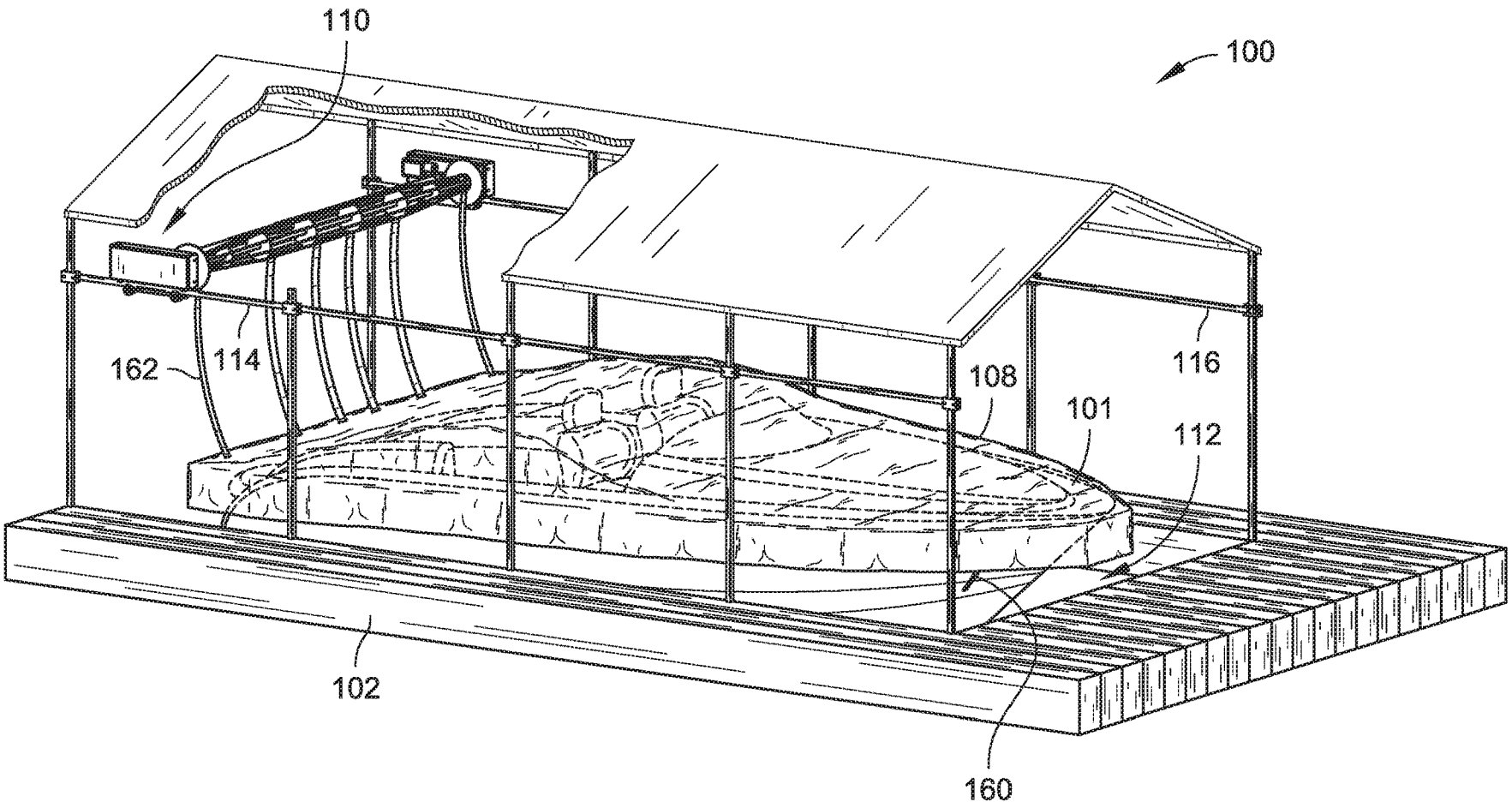
FIG. 2 is a front, side isometric view of the automatic cover delivery system of FIG. 1, with the cover fully deployed.

FIGS. 1 and 2 illustrate a watercraft receiving system 100 for receiving and protecting a watercraft 101 (e.g., boat, personal watercraft, etc.), in accordance with an embodiment of the present disclosure. The watercraft receiving system 100 can include a dock 102 (e.g., a pier, a wharf, a floating platform), a surrounding support structure 104, a roof 106, a cover 108, and a cover delivery system 110. The dock 102 can be configured to be positioned over a body a water (not shown) (e.g., near shore to permit easy access to the watercraft 101) and can define a dock slip 112 for receiving the watercraft 101. The dock 102 can be particularly configured as location to park a watercraft 101 in the water, with the dock slip 112 defining the parking slot for the watercraft 101. The dock 102 may advantageously be in a location that can be generally accessible from a nearby shore, allowing a user to access the watercraft 101 without necessarily needing, e.g., to get in the water to access it. The dock 102 may be designed to float relative to the body of water upon which it resides and/or may be fixed in place (e.g., relative to the ground over which the body of water resides).

The support structure 104 can be mounted relative (e.g., attached directly or indirectly) to the dock 102 and can carry the cover delivery system 110 and, if present, the roof 106. In the illustrated embodiment, the support structure 104 can be affixed to the dock 102 around the perimeter of the dock slip 112 (i.e., the interior of the dock 102), meaning that the roof 106, if present, may be configured to cover the watercraft 101 and the area of water bounded by the dock slip 112. However, it is to be understood that the support structure 104 may instead extend from the exterior of the dock 102, so that, when the roof 106 is present, coverage (e.g., shade and/or rain protection) may be provided to anyone on the surrounding dock 102, in addition to the watercraft 101. In any case, the support structure 104 can provide a framework for carrying the cover delivery system 110 at position above (e.g., overhead) the watercraft 101. The support structure 104 may take any form (e.g., simple frame, lattice, etc.) so long as it is able to carry the cover delivery system 110 and, if present, the roof 106.

The cover delivery system 110 (e.g., for use in selectably covering a watercraft 101), in accordance with an example embodiment of the present disclosure, generally includes a first rail 114, a second rail 116 spaced apart from and extending generally parallel to the first rail 114, and a cover delivery device 118. The cover delivery device 118 can include a first mobile support assembly 120, a second mobile support assembly 122, a shaft 124 (e.g., a drive shaft), and a cover carrier mechanism 126. The first mobile support assembly 120 can be mounted to and configured for movement along the first rail 114. The second mobile support assembly 122 can be mounted to and configured for movement along the second rail 116. The drive shaft 124 extends between the first mobile support assembly 120 and the second mobile support assembly 122 and can be used to transmit power needed to drive the cover delivery device 118 relative to the rails 114, 116. The cover carrier mechanism 126 can extend between and be rotatably mounted to the first mobile support assembly 120 and the second mobile support assembly 122. In some embodiments, the cover carrier mechanism 126 can be configured for selectably deploying the cover 108 carried thereby, with the cover carrier mechanism 126 being configured to selectably roll and unroll (e.g., wind and unwind) the cover 108 relative thereto.

The first rail 114 and the second rail 116, per the illustrated embodiment, can be mounted to or otherwise carried the support structure 104. The first rail 114 and the second rail 116, in some embodiments, may extend generally parallel to one another and/or to the dock 102. The first rail 114 and the second rail 116 can be positioned on the support structure at a height (e.g., 5-7 feet for small craft) relative to the dock 102 so as to be above any watercraft 101 that may park in the related dock slip 112. Choosing the mounting height of the first rail 114 and the second rail 116 in such a manner can ensure clearance of the cover delivery device 118 while travelling over a corresponding watercraft 101. The first rail 114 and the second rail 116 together establish a linear travel path for the cover delivery device 118, thereby simplifying the operation of the overall system (e.g., stationary support for the cover delivery device 118; and assured cleared distance overtop of a given watercraft 101).

Figure 3:
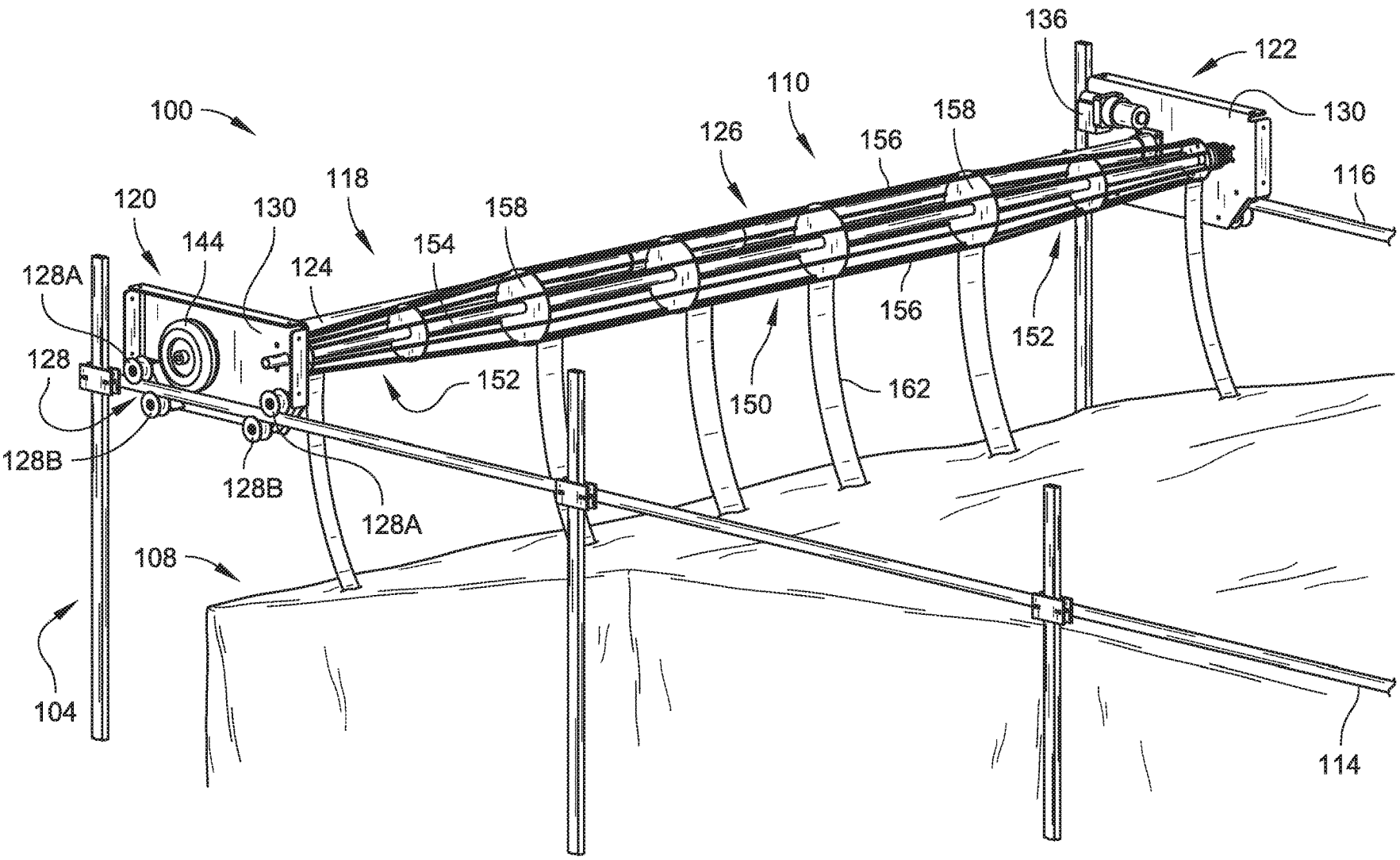
FIG. 3 is a front isometric view of the automatic cover delivery device of the overall automatic cover delivery system shown in FIG. 1.
Figure 4:
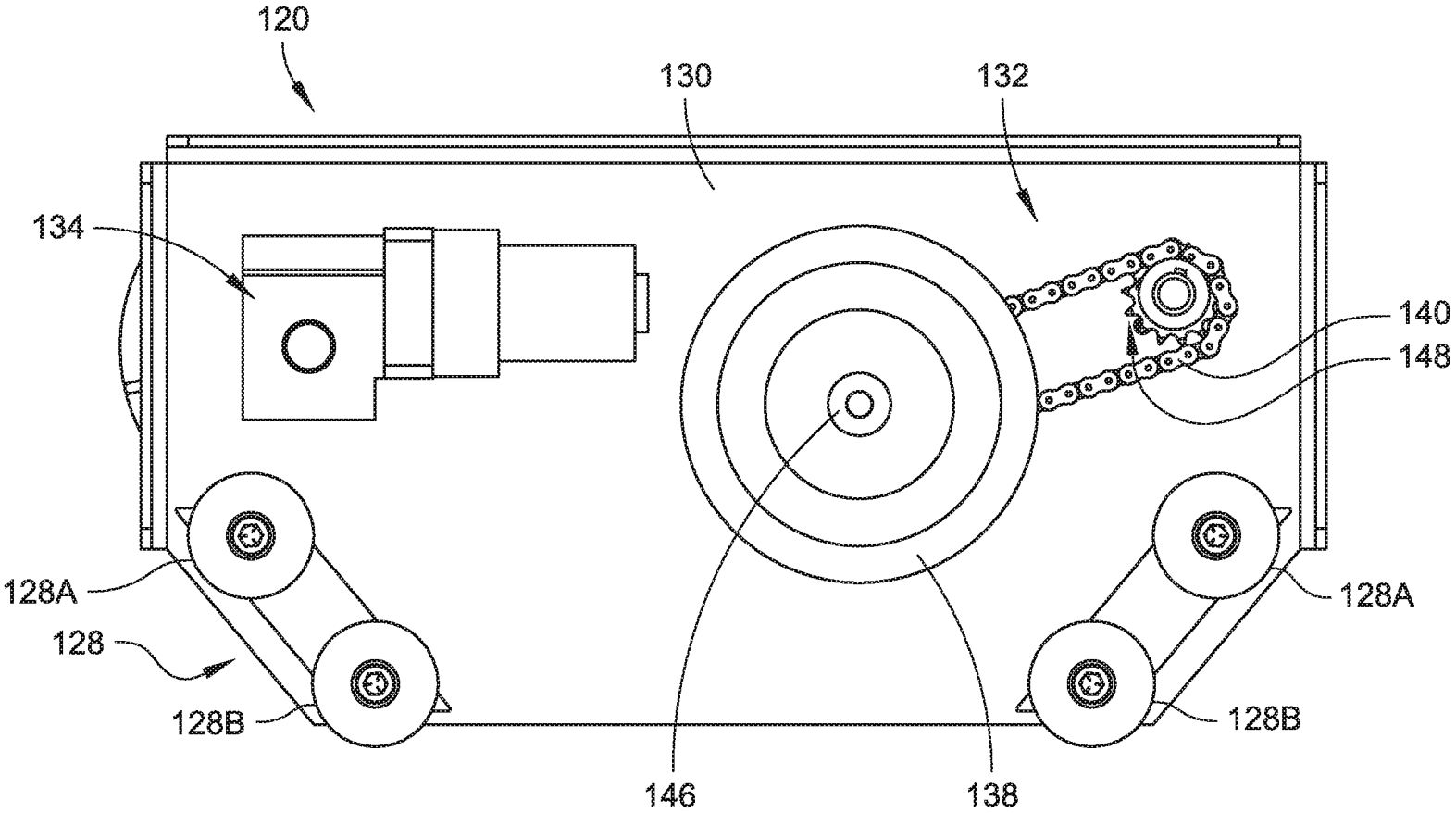
FIG. 4 is a side view of a given mobile support assembly of the automatic cover delivery system shown in FIG. 3.

In some implementations, the first mobile support assembly 120 and the second mobile support assembly 122 (e.g., shown further in FIGS. 3-4) together can be configured to translate the cover carrier mechanism 126 along the first rail 114 and the second rail 116 and to facilitate the driven rotation of the cover carrier mechanism 126, as it is translated along the rails 114, 116. The first mobile support assembly 120 and the second mobile support assembly 122 can each include a set of idler wheels 128 and a support frame 130. The idler wheels 128 can be carried by the respective support frame 130 and facilitate a roller-based connection with a respective one of the first rail 114 and the second rail 116. Each set of idler wheels 128 may include at least one upper idler wheel **128*a* and at least one lower idler wheel 128*b* to help retain the corresponding mobile support assembly 120, 122 in contact with the respective rail 114, 116 (e.g., vertical retention provided by upper and lower idler wheels 128*a*, 128*b*). Each idler wheel 128 may be outwardly concave (e.g., defining a retention groove in its diameter) to aid in the lateral retention (e.g., side-to-side) of a set of idler wheels 128 relative to a corresponding rail 114, 116. Thus, a given set of idler wheels 128 may together, for example, limit the first mobile support assembly 120 and/or the second mobile support assembly 122 to one degree of freedom (e.g., along the length of a respective rail 114, 116**).

The first mobile support assembly 120 and the second mobile support assembly 122, in some embodiments, can have two different drive systems associated therewith. The two different drive systems can be a rail drive system 132 (i.e., for promoting conveyance along the respective rails 114, 116) and a cover carrier rotation drive 134 (i.e., for winding or unwinding the cover 108), used singularly or in tandem. In some embodiments, the rail drive system 130 can include a rail drive motor 136 (shown schematically and in phantom in FIG. 4), a first drive wheel 138, a drive transmission link 140 (e.g., a drive chain, as illustrated, or a drive belt), the drive shaft 124, and a second drive wheel 144. In the illustrated embodiment, the rail drive motor 136 can be fixedly mounted to the support frame 130 of the second mobile support assembly 122, and the first drive wheel 138 can be rotatably mounted relative to the same respective support frame 130 via the drive shaft 124 (e.g., particularly at a first shaft end 146). The drive shaft 124 and the rail drive motor 136 may, for example, employ, such as shown, a drive chain as the drive transmission link 140 and related gearing 148, and/or a belt-drive system (not shown), as needed to transmit drive from the rail drive motor 136. The rail drive motor 136 may be provided with at least a forward gear and a reverse gear to facilitate movement of the cover carrier mechanism 126 in either rail direction, as needed, to selectably deploy the cover 108 (e.g., perform a covering or an uncovering action).

The drive shaft 124 can extend to the other (i.e., the first) mobile support assembly 120, where a second shaft end 148 thereof can be rotatably mounted relative to the support frame 130 of the first mobile support assembly 120. The second shaft end 148 can rotatably carry the second drive wheel 144. The drive shaft 124, in some embodiments, can transfer torque (e.g., initially generated by the rail drive motor 136) to the second drive wheel 144. Additionally, the presence of the drive shaft 124 can help stabilize the overall connection between the first mobile support assembly 120 and the second mobile support assembly 122 (e.g., two shafts (e.g., the drive shaft 124 and that associated with the cover carrier mechanism 126) interconnecting the two reduces the opportunity for, e.g., twisting, etc.). That is, even if the drive shaft 124 were not to be torque-transmitting (e.g., a rotary, non-driven shaft), it may still be beneficial to the operation of the system from an aspect of mechanical stability. Further, the first drive wheel 138 and the second drive wheel 144 may be made of a resilient and/or compliant material (e.g., rubber or another elastomer) to facilitate gripping thereof with a corresponding rail 114, 116.

The second drive system that may be associated with the first mobile support assembly 120 and/or the second mobile support assembly 122, as per above, is the cover carrier rotation drive 134. The cover carrier rotation drive 134 can be configured for rotatably driving the cover carrier mechanism and can, in some embodiments, be in the form of a slip clutch drive 146. The slip clutch drive 146, in some embodiments, may be operatively mounted on the support frame 130 of the second mobile support assembly 122, but it is to be understood that it could instead be mounted on the first mobile support assembly 120. The slip clutch drive 146 can, in some embodiments, be directly linked (e.g., via a direct drive linkage) to the cover carrier mechanism 126. The slip clutch drive, by its design, offers the ability to limit the torque generated thereby (e.g., via slipping or spinning), thus allowing the cover to be wound or unwound (e.g., rolled/unrolled) at a substantially constant rate. Such a rate control ultimately helps to deliver a better fit of the cover 108 upon delivery upon the watercraft 101 (e.g., a tighter, more even fit) and to more efficiently roll the cover 108 upon collection thereof onto the cover carrier mechanism 126. In some embodiments, the cover carrier rotation drive 134 can be provided with a forward gear and a reverse gear to facilitate both rolling and unrolling of the cover 108. In some embodiments the rail drive system 132 and the cover carrier rotation drive 134 may, instead, be positively driven in one direction and capable of being in neutral, at least for the opposite direction. For example, it may be possible to use the winding action of the cover carrier drive 134 to power movement of the cover delivery device 118 in a first direction and then to use the rail drive system 132 to facilitate movement in the opposite direction.

The cover carrier mechanism 126, in some implementations, can be configured for carrying and selectably deploying the cover 108 (e.g., via rolling and unrolling) relative to the watercraft 101. The cover carrier mechanism 126 defines a carrier middle 150 and a pair of carrier ends 152, with the carrier middle 150 being located between the pair of carrier ends 152. In some embodiments (such as that shown), the carrier middle 150 may be greater in diameter than the carrier ends 152. The differential diameter along the cover carrier mechanism 126 can aid in centering the cover 108 thereon, particularly during winding and unwinding of the cover 108. In some embodiments, such as that shown in FIG. 3, the cover carrier mechanism 126 may define a central carrier shaft 154, a plurality of outer carrier members 156 (e.g., formed rods, cables, wires, slats), and a plurality of spacers 158. The central carrier shaft 154 can be rotatably mounted relative to each of the first mobile support assembly 120 and the second mobile support assembly 122 and may be driven, for example, by the slip clutch drive 146, as discussed above in greater detail. The plurality of spacers 158 (e.g., in the form of disks (as shown); spokes; etc.) can be received at various positions (e.g., evenly spaced; spaced based upon loading; etc.) along the length of the central carrier shaft 154 and can serve to connect and carry the outer carrier members 156 in a respective fixed position (e.g., angle and/or distance) relative to the central carrier shaft 154. In some embodiments, the cover carrier mechanism 126 may, instead, be a unitary member (e.g., comprised primarily of a central carrier shaft 154), and, in such a case, the unitary member may yet further be formed so as to be greater in diameter in its middle than at its ends. The use of a combination of outer carrier members 156 and spacers 158 (e.g., opposed to a unitary carrier) may reduce the total weight associated with the cover carrier mechanism 126, making it easier to power and/or easier to support.

The cover 108 may have a plurality of tie-down ropes 160 and/or a plurality of carrier straps 162 extending therefrom (e.g., attached to (e.g., tied and/or sewn) and/or integrally formed therewith) or otherwise carried thereby. The tie-down ropes 160 may be used to tie the cover 108 to the watercraft 101 and thus help hold the cover 108 in place during storage. The carrier straps 162 can be configured to allow the cover 108 to remain connected to the cover carrier mechanism 126, even when the cover 108 is deployed on the watercraft 101 (e.g., substantially covering the watercraft 101 at least above the waterline), as seen from FIG. 2. Because a connection (e.g., tether) with the cover carrier mechanism 126 is able to be maintained via the carrier straps 162, when desired, the rewinding process may be begin immediately, without having to reattach and/or "rethread" the cover 108 onto the cover carrier mechanism 126 at the beginning of a given rewind sequence. The carrier straps 162, in addition to being connected to the cover 108, can be connected, for example, to the central carrier shaft 154 or a given outer carrier member 156 (e.g., via a loop built into a given carrier strap 162, mechanical fastener, etc.).

It is to be understood that, while the cover delivery system 110 has been described for use in relation to covering a wet-docked watercraft 101, that system may have other uses, as appreciated by one of ordinary skill in the art. For example, the cover delivery system 110 may be used in a dry-dock storage arrangement for a watercraft 101. Additionally, the cover delivery system 110 may be incorporated, e.g., into a carport or a garage (i.e., without a dock) to aid in the covering a land-based vehicle (e.g., car, truck, motorcycle).

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A cover delivery device, comprising:

a first mobile support assembly configured for movement along a first rail;

a second mobile support assembly configured for movement along a second rail, the second rail being generally parallel to the first rail; and a cover carrier mechanism extending between and rotatably mounted to the first mobile support assembly and the second mobile support assembly, the cover carrier mechanism including a plurality of outer carrier members coupled with a plurality of spacers, the plurality of spacers positioned along the length of a central carrier shaft and configured to carry the plurality of outer carrier members in a fixed position relative to the central carrier shaft, the cover carrier mechanism being configured for selectably deploying a cover carried thereby, the cover carrier mechanism being configured to respectively roll and unroll the cover relative thereto.

2. The cover delivery device of claim 1, wherein the first mobile support assembly, the second mobile support assembly, and the cover carrier mechanism are respectively configured to move with respect to one another so as to control a delivery of the cover relative to an expanse of a watercraft.

3. The cover delivery device of claim 2, wherein the first mobile support assembly, the second mobile support assembly, and the cover carrier mechanism are respectively configured to move with respect to one another so to feed the cover out over the expanse of the watercraft.

4. The cover delivery device of claim 2, wherein the first mobile support assembly, the second mobile support assembly, and the cover carrier mechanism are respectively configured to move with respect to one another so to retrieve the cover from the expanse of the watercraft.

5. The cover delivery device of claim 1, wherein the first mobile support assembly and the second mobile support assembly respectively includes a corresponding support frame and a corresponding plurality of idler wheels, the corresponding support frame rotatably carrying the cover carrier mechanism, the corresponding plurality of idler wheels being configured to facilitate movement thereof relative to at least one of a corresponding first rail or a corresponding second rail.

6. The cover delivery device of claim 1, wherein the cover delivery device is configured for being mounted above a dock slip for receiving a watercraft, the cover carrier mechanism being configured for selectably deploying the cover carried thereby relative to the watercraft.

7. The cover delivery device of claim 1, wherein the cover carrier mechanism defines a carrier middle and a pair of carrier ends, the carrier middle being located between the pair of carrier ends, the carrier middle being greater in diameter than the carrier ends, the cover carrier mechanism narrowing continuously along the length of the central carrier shaft from proximate to the carrier middle towards each of the pair of carrier ends.

8. The cover delivery device of claim 7, wherein at least two of the plurality of spacers positioned on each side of the cover carrier mechanism form the continuous narrowing towards each of the pair of carrier ends.

9. The cover delivery device of claim 1, further comprising a rail drive mounted to at least one of the first mobile support assembly or the second mobile support assembly, the rail drive being configured to selectably move the one of the first mobile support assembly or the second mobile support assembly relative to the respective one of a first rail or a second rail.

10. The cover delivery device of claim 9, wherein the rail drive further includes a drive shaft operatively rotated by the rail drive motor, the drive shaft being configured for driving both the first mobile support assembly and the second mobile support assembly relative to a respective one of the first rail or the second rail.

11. A cover delivery mechanism, comprising:

a first rail;

a second rail spaced apart from and generally parallel to the first rail; and a cover delivery device, comprising:

a first mobile support assembly mounted to and configured for movement along the first rail;

a second mobile support assembly mounted to and configured for movement along the second rail; and a cover carrier mechanism extending between and rotatably mounted to the first mobile support assembly and the second mobile support assembly, the cover carrier mechanism including a plurality of outer carrier members coupled with a plurality of spacers, the plurality of spacers positioned along the length of a central carrier shaft and configured to carry the plurality of outer carrier members in a fixed position relative to the central carrier shaft, the cover carrier mechanism being configured for selectably deploying a cover carried thereby, the cover carrier mechanism being configured to respectively roll and unroll the cover relative thereto.

12. The cover delivery mechanism of claim 11, wherein the first rail and the second rail are mounted at a height so as to be able to receive a watercraft therebelow, the cover carrier mechanism being configured to selectably deploy the cover carried thereby relative to the watercraft.

13. The cover delivery mechanism of claim 11, wherein at least one of the first mobile support assembly or the second mobile support assembly has at least one of a rail drive system or a cover carrier rotation drive associated therewith, the rail drive system being configured for promoting conveyance along at least one of the first rail or the second rail, the cover carrier rotation drive being configured for selectably winding or unwinding the cover.

14. The cover delivery mechanism of claim 13, wherein a rail drive system is provided, and the rail drive system includes a rail drive motor, a first drive wheel, and a drive transmission link, the drive transmission link being configured to operatively connect the rail drive motor to the first drive wheel.

15. The cover delivery mechanism of claim 11, wherein the cover carrier mechanism defines a carrier middle and a pair of carrier ends, the carrier middle being located between the pair of carrier ends, the carrier middle being greater in diameter than the carrier ends, the cover carrier mechanism narrowing continuously along the length of the central carrier shaft from proximate to the carrier middle towards each of the pair of carrier ends.

16. A watercraft docking system, comprising:

a dock configured to be mounted over a body of water, the dock defining a dock slip, the dock slip configured to receive a watercraft therein;

a support structure carried by the dock, the support structure configured to extend to a height above a given watercraft received in the dock slip;

a first rail carried by the support structure;

a second rail carried by the support structure, the second rail being spaced apart from and generally parallel to the first rail; and a cover delivery device, comprising:

a first mobile support assembly mounted to and configured for movement along the first rail;

a second mobile support assembly mounted to and configured for movement along the second rail; and a cover carrier mechanism extending between and rotatably mounted to the first mobile support assembly and the second mobile support assembly, the cover carrier mechanism including a plurality of outer carrier members coupled with a plurality of spacers, the plurality of spacers positioned along the length of a central carrier shaft and configured to carry the plurality of outer carrier members in a fixed position relative to the central carrier shaft, the cover carrier mechanism being configured for selectably deploying a cover carried thereby relative to the watercraft, the cover carrier mechanism being configured to respectively roll and unroll the cover relative thereto.

17. The watercraft docking system of claim 16, wherein the support structure further has a roof mounted thereto, the roof being configured to extend overtop of a given watercraft received in the dock slip.

18. The watercraft docking system of claim 16, wherein the first rail and the second rail are mounted at a height so as to be able to receive a watercraft therebelow, the cover carrier mechanism being configured to selectably deploy the cover carried thereby relative to the watercraft.

19. The watercraft docking system of claim 16, wherein at least one of the first mobile support assembly or the second mobile support assembly has at least one of a rail drive system or a cover carrier rotation drive associated therewith, the rail drive system being configured for promoting conveyance along at least one of the first rail or the second rail, the cover carrier rotation drive being configured for selectably winding or unwinding the cover.

20. The watercraft docking system of claim 16, wherein the cover carrier mechanism defines a carrier middle and a pair of carrier ends, the carrier middle being located between the pair of carrier ends, the carrier middle being greater in diameter than the carrier ends, the cover carrier mechanism narrowing continuously along the length of the central carrier shaft from proximate to the carrier middle towards each of the pair of carrier ends.

* * * * *